United States Patent [19]

Glanvall

[11] 4,239,467

[45] Dec. 16, 1980

[54] ROTARY COMPRESSOR WITH VALVED LIQUID INJECTION THROUGH THE ROTOR

[75] Inventor: Rune V. Glanvall, Norrkoping, Sweden

[73] Assignee: Stal Refrigeration AB, Norrkoping, Switzerland

[21] Appl. No.: 950,558

[22] Filed: Oct. 12, 1978

[30] Foreign Application Priority Data

Oct. 13, 1977 [SE] Sweden ..... 7711558

[51] Int. Cl.[3] ..... F04C 29/02; F04C 29/08

[52] U.S. Cl. ..... 418/76; 418/82; 418/91; 418/94; 418/99; 418/184

[58] Field of Search ..... 418/87, 91–94, 418/99, 183, 184, 76, 82

[56] References Cited

U.S. PATENT DOCUMENTS

| | | | |
|---|---|---|---|
| 1,781,073 | 11/1930 | Nielsen | 418/99 |
| 2,877,946 | 3/1959 | Garrison et al. | 418/93 |
| 3,900,277 | 8/1975 | Newton | 418/184 |

FOREIGN PATENT DOCUMENTS

| | | | |
|---|---|---|---|
| 1172397 | 6/1964 | Fed. Rep. of Germany | 418/92 |
| 355457 | 8/1931 | United Kingdom | 418/93 |

*Primary Examiner*—John J. Vrablik
*Attorney, Agent, or Firm*—Cyrus S. Hapgood

[57] ABSTRACT

In a rotary compressor of the sliding vane type, the vanes maintain sliding contact with the inner wall of the housing while moving periodically inward and outward in generally radial slots in the cylindrical rotor, which is provided with conduits for injecting oil or other liquid into the working chambers formed by the rotor, the vanes and the housing's inner wall. The housing has inlet ports for a gas to be compressed in the working chambers and has outlet ports for the compressed gas. Valves are provided to open and close said rotor conduits in synchronism with said periodic moving of the vanes, whereby the liquid is injected into the working chambers only during such periods when these chambers are closed to the gas inlet and outlet ports.

4 Claims, 10 Drawing Figures

ROTARY COMPRESSOR WITH VALVED LIQUID INJECTION THROUGH THE ROTOR

Figure 1:
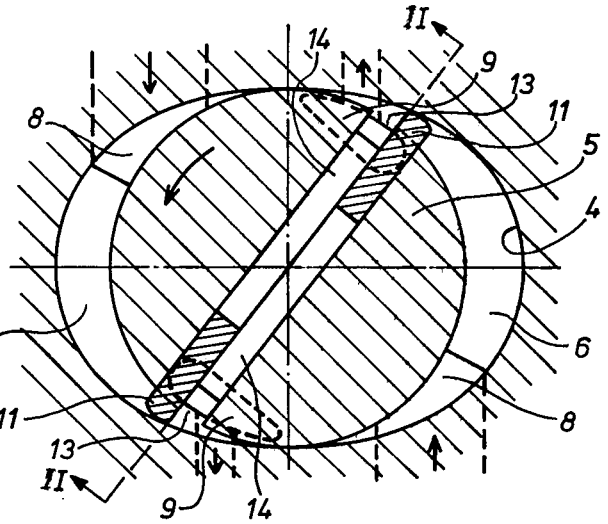

The present invention relates to a rotary compressor of the sliding vane type comprising a housing provided with inlet ports for a gas to be compressed and outlet ports for compressed gas, and a cylindrical rotor journalled in the housing and provided with vanes slidable in slots in the rotor, the vanes being arranged to sealingly slide against the inside surface of the housing to form working spaces between the rotor, the inside surface of the housing and the vanes.

More specifically, the invention relates to new details for controlling liquid injection in a compressor of the type mentioned above. In this context, the term liquid injection primarily refers to injection of oil for lubrication, sealing and possibly also cooling, but the invention can also be applied for injection of other liquids such as the injection of refrigerant into a cooling compressor to cool the same. The description below refers particularly to a cooling compressor in which oil is injected for said purpose. The oil which, in an oil circulation system, is introduced into and discharged from the working space of a cooling compressor contains a considerable amount of dissolved refrigerant, which is partially vaporized when the oil enters the working space of the compressor during a period when low pressure prevails in said space. It is therefore desirable to arrange the oil injection so that it does not occur during those periods when the refrigerant which vaporizes from the oil will replace and thereby reduce the intake of uncompressed refrigerant gas, thus reducing the volumetric efficiency as well as the total efficiency of the compressor. To avoid back flow in the oil circulation system, it is also important that the injection conduits do not open against a compressor working space pressure which is higher than the oil injection pressure.

A usual way to arrange oil injection in a rotary sliding vane compressor is to arrange injection conduits through the cylindrical housing wall directly into the working space of the compressor. In certain embodiments with a low number of rotor vanes, however, it is not possible to avoid direct connection between the injection conduits and the inlet ports and the outlet ports of the compressor, with the unsatisfactory result mentioned above (reduced efficiency and the risk of back flow in the oil circulation system).

The principal object of the present invention is to provide a rotary compressor of the previously mentioned type in which said unfavorable effects are avoided.

This object is attained by a rotary compressor which, according to the invention, is characterized in that conduits for liquid injection are arranged in the rotor with inlets at one or both of the end walls of the rotor and outlets in the peripheral surface of the rotor towards the working spaces, and that valve members operating in response to the movement of the vanes are arranged to open and close the connection between said inlets and outlets in synchronization with the periodic sliding of the vanes in the rotor slots.

Thus, in a rotary compressor according to the invention, the above-mentioned problem with liquid injection has been solved by utilizing the periodic movement of the vanes in the rotor slots to open and close the liquid input to the working spaces of the compressor. The valve members controlled by the movement of the vanes may consist of any mechanical devices which, at the desired periods, open and close grooves or conduits arranged in the rotor for liquid injection and leading through openings in the peripheral surface of the rotor to the working spaces. However, the part of an oil injection conduit in the rotor which is located between the closing point and the opening in the rotor peripheral surface to the working spaces will always be open and form a so-called detrimental volume, which impairs the efficiency of the compressor. Therefore, the closing point should be arranged as close as possible to the opening of the injection conduit at the rotor periphery. Alternatively, the problem caused by the detrimental volume in the oil conduits can be solved by filling up said volume mechanically during those critical periods when the working spaces of the compressor are connected to the inlet ports and the outlet ports.

The last alternative is utilized in an advantageous embodiment of the present invention. In this embodiment, each valve member consists of a piston element connected with the corresponding vane, said piston element being movable in a recess made in the rotor diametrically opposite the corresonding vane and arranged to open and close an oil injection opening in the recess and to simultaneously fill up the recess during the inlet and outlet periods.

The invention can be advantageously applied to a rotary compressor of the type described in Swedish patent appplication No. 7602477-7. This compressor is provided with inlet ports and outlet ports in the end walls of the housing and with rotor recesses which, during the inlet periods and outlet periods, connect the working spaces of the compressor with said ports, the compressor also being provided with piston elements movably arranged in said recesses diametrically opposite each vane, the purpose of said piston elements being to gradually fill up the recesses during the outlet periods. By arranging the oil injection through conduits in the rotor or grooves in the end walls of the housing into said recesses, said piston elements can simultaneously be arranged to form the valve members in a compressor according to the present invention. In the following, different embodiments of the invention as applied to a rotary compressor according to said Swedish patent application No. 7602477-7 will be described. Obviously, the invention is not limited to this type of compressor but can be applied to compressors having completely different outlet and inlet arrangements. Thus, the oil injection valve members according to the invention can be used as well in compressors such as those having outlet ports for compressed gas arranged in the cylindrical housing wall. It is also obvious that the advantageous arrangement of filling and eliminating the detrimental space in the oil injection conduits by means of the valve members can be utilized in any type of rotary sliding vane compressor.

The following description refers to the attached drawings, in which

Figure 2:
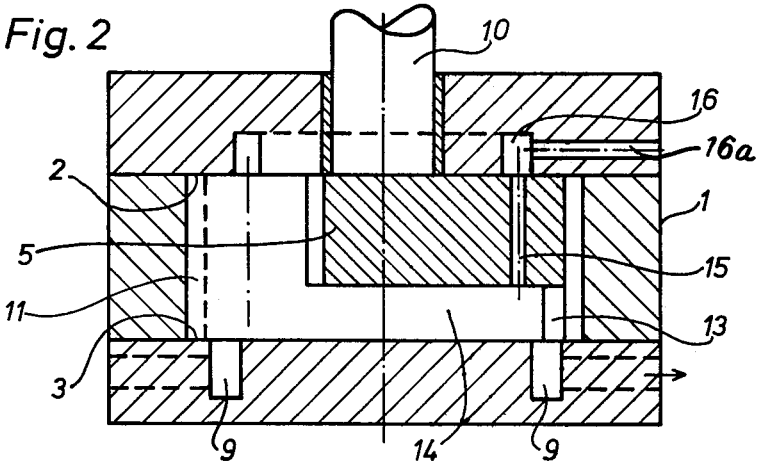
Figure 3:
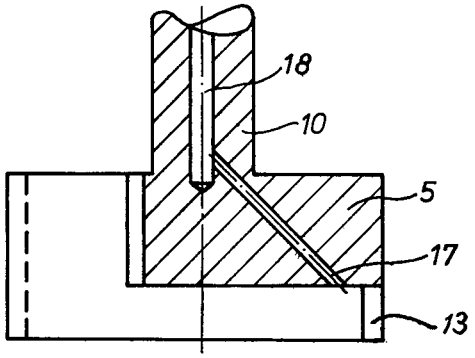
Figure 6:
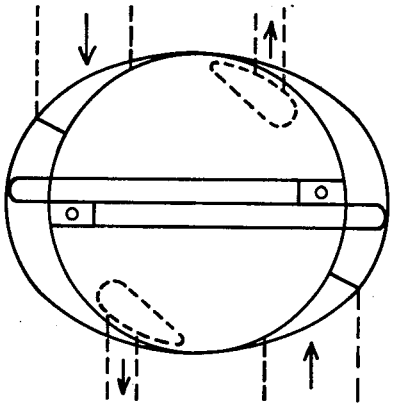
Figure 7:
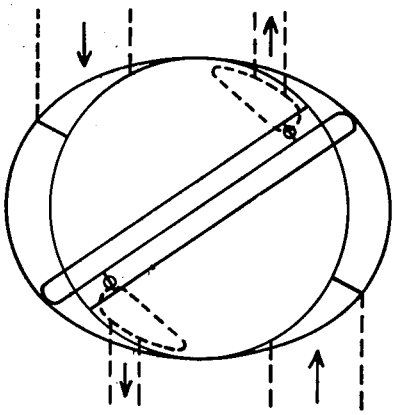
Figure 8:
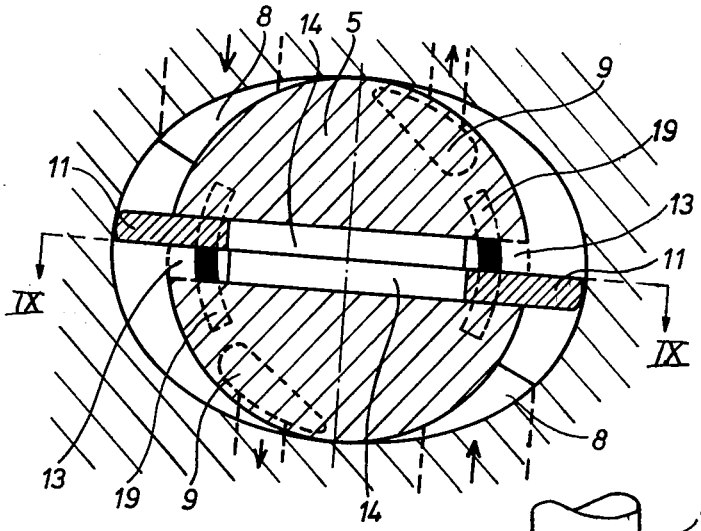
Figure 9:
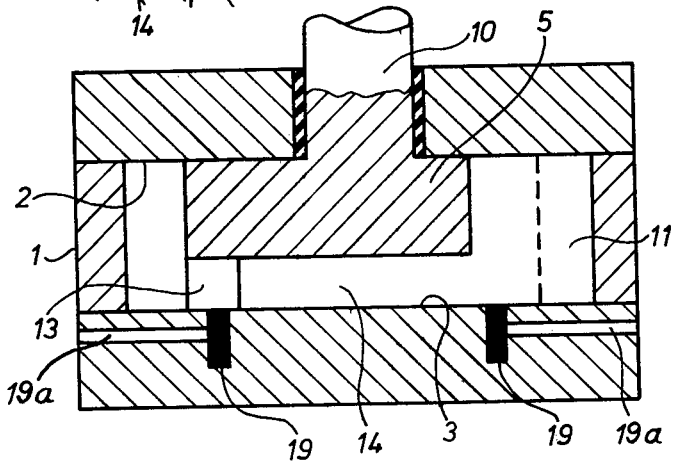
Figure 10:
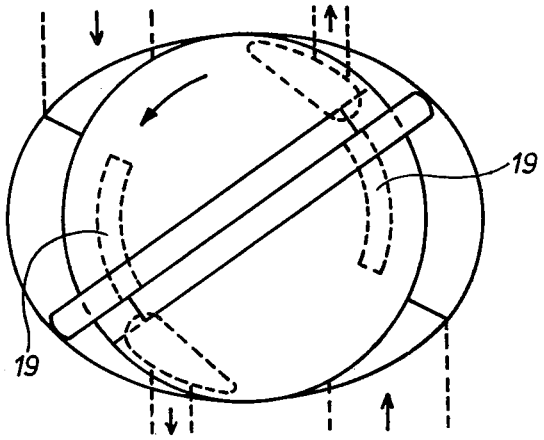

FIG. 1 shows a cross section of a first embodiment of a rotary compressor according to the invention, FIG. 2 shows a longitudinal section of the compressor in FIG. 1 on the line I—I, FIG. 3 shows a longitudinal section through the rotor of a second embodiment of the invention, FIGS. 4–7 schematically show the positions of the vanes and the valve members at different rotor positions in the embodiments according to FIGS. 1–3, FIG. 8 shows a cross section through a third embodiment of the compressor according to the invention, FIG. 9 shows a longitudinal section of the compressor in FIG. 8 on the line II—II, and FIG. 10 schematically shows a number of rotor positions in the compressor of FIG. 8.

The compressor shown in FIGS. 1 and 2 comprises a housing 1 which is internally limited by two plane parallel end walls 2 and 3 and by a cylindrical peripheral wall 4 with an elliptic-like cross section. In the housing 1 a cylindrical rotor 5 is journalled, the rotor dividing the internal space of the housing into two identical working chambers 6 and 7. Each working chamber is provided with an inlet port 8 and an outlet port 9 arranged in the end wall 3.

The rotor 5 is connected with a drive shaft 10 and is provided with vanes 11 which are slidingly located in axial slots of the rotor to sealingly slide against the walls of the working chambers 6 and 7. The rotor is further provided at both ends with recesses 13 which cooperate with the outlet ports 9 in the end walls 3 to form discharge passages for compressed gas. Radially inside each of the recesses 13 there is a valve member 14 which is connected to the diametrically opposite vane 11 and is therefore movable with the same. In this embodiment, the valve member 14 is made in one piece with the vane 11.

In the end wall 2 there is a groove 16 which receives oil from a passage 16*a*. Permanently or periodically during rotation of the rotor, groove 16 is connected with conduits 15 arranged in the rotor parallel with the rotor shaft 10 to end in the slots of the valve members 14 at such a position that each valve member 14 during certain periods of the working cycle will close the openings of the conduits 15 to the recesses 13.

Shown in FIG. 3 is a modification of the embodiment according to FIGS. 1 and 2, the modification being that the oil injection is arranged through the rotor shaft. In the rotor 5, conduits 17 are arranged which are connected with one or several passages or conduits 18 in the rotor shaft 10.

Figure 4:
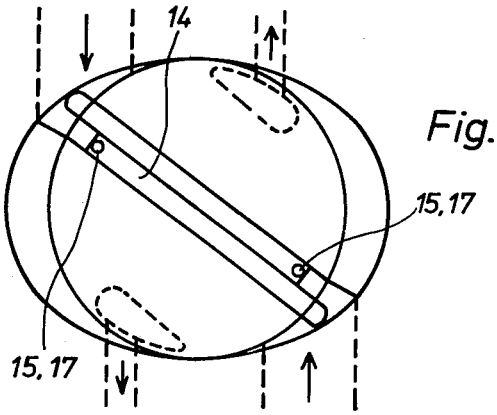
Figure 5:
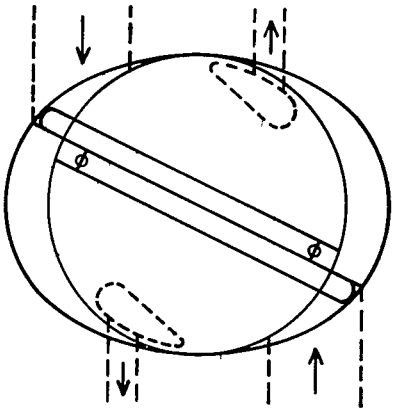

Referring to FIGS. 4–7, the valve members 14 in FIG. 4 cover the injection conduits 15 and 17 respectively during the suction period; in FIGS. 5–6 the conduits 15 and 17 are opened to the working chambers 6 and 7; and in FIG. 7 the conduits 14 and 17 are closed again at the beginning of the exhaust period. Thus, the oil injection into the working chambers 6 and 7 will occur only during such periods when the working chambers are closed to the inlet ports 8 and the outlet ports 9. From the embodiments described above, it is quite obvious that the oil injection period can be restricted to those working periods when the pressure in the working chambers is less than the oil pressure.

As will be apparent from the foregoing, the liquid injection conduits in rotor 5 of FIGS. 1 and 2 include passages of which one is shown at 15 (FIG. 2) and also include the recesses 13 forming the outlets of the injection conduits.

In the third embodiment shown in FIGS. 8 and 9, the oil injection conduits in the rotor consist of the recesses 13 themselves, which are arranged in the edge part of the rotor. The recesses 13 are periodically connected with oil injection grooves 19 in the end wall 3, these grooves receiving the oil from passages 19*a*. In FIG. 8, it is demonstrated how the valve members 14 open the connection between the grooves 19 and the recesses 13 during a period when the working chambers 6 and 7 do not communicate with the inlet ports or the outlet ports 8 and 9, respectively. In FIG. 10, it is demonstrated schematically how the valve members 14 close the connection between the grooves 19 and the recesses 13 to gradually fill up said receses during the discharge period.

As previously stated, the invention is not restricted to rotary compressors having inlet ports and outlet ports arranged in the end walls to cooperate with recesses in the rotor. The advantage of using valve members arranged in the recesses in the rotor can also be utilized in compresors having inlet ports and/or outlet ports in the cylindrical peripheral wall of the housing, the valve members serving the double purposes of opening and closing oil injection conduits and filling up the remaining detrimental volume in said conduits.

I claim:

1. A rotary compressor of the sliding vane type comprising a housing having an inner surface and provided with inlet ports for a gas to be compressed and with outlet ports for compressed gas, a cylindrical rotor journalled in the housing for rotation about an axis and having slots opening through the peripheral surface of the rotor, vanes movable in said slots generally radially of the rotor and adapted to slide sealingly against said inner surface of the housing, the vanes being movable periodically inward and outward in the slots during rotation of the rotor, working chambers being formed between the rotor, said inner surface of the housing and the vanes, the rotor having conduits for liquid injection, said conduits having inlets in at least one end wall of the rotor and having outlets in said peripheral surface of the rotor toward the working chambers, and valve members movable in response to movement of the vanes and operable to open and close said conduits between said inlets and outlets in synchronization with said periodic moving of the vanes, the housing having internal end walls opposing the end walls of the cylindrical rotor, said outlet ports being located in at least one of said housing end walls, the rotor conduits including recesses coacting with said outlet ports to form outlet paths for compressed gas, said valve members being piston elements movable in said recesses at locations diametrically opposite respective vanes, the piston elements being operable periodically, during rotation of the rotor, to gradually fill said recesses and simultaneously block liquid flow through the rotor conduits.

2. The compressor of claim 1, in which at least one of said housing end walls has grooves for receiving liquid to be injected, said grooves being positioned for connection to the rotor conduits at least periodically during rotation of the rotor.

3. The compressor of claim 1, in which the rotor has a drive shaft provided with at least one liquid supply passage connected to said rotor conduits.

4. The compressor of claim 1, in which at least one of said housing end walls has grooves for receiving liquid to be injected, said rotor conduits consisting of recesses located in edge portions of the rotor in position to be directly connected to said grooves at least periodically during rotation of the rotor.

* * * * *